US005158517A

United States Patent [19]

Steggert

[11] Patent Number: 5,158,517

[45] Date of Patent: Oct. 27, 1992

[54] THROWING ARM EXERCISING APPARATUS

[76] Inventor: Peter F. Steggert, 2009 Brian Way, Decatur, Ga. 30033

[21] Appl. No.: 766,130

[22] Filed: Sep. 27, 1991

[51] Int. Cl.[5] ..... A63B 21/062

[52] U.S. Cl. ..... 482/98; 482/20

[58] Field of Search ..... 272/117, 118, 900, 93; 482/93, 98, 99, 148

[56] References Cited

U.S. PATENT DOCUMENTS

| | | | |
|---|---|---|---|
| 2,134,451 | 10/1938 | Mogren | 272/117 |
| 3,502,329 | 3/1970 | Brazier | 272/117 |
| 4,109,907 | 8/1978 | Zito | 272/900 |
| 4,895,363 | 1/1990 | Plevnik et al. | 272/93 |
| 4,974,836 | 12/1990 | Hirsch | 272/900 |

*Primary Examiner*—Stephen R. Crow
*Attorney, Agent, or Firm*—James B. Middleton

[57] ABSTRACT

An exercising device is designed to exercise precisely the muscles, and groups of muscles, used in throwing a ball, such as in pitching a baseball. A simulated ball has a line fixed thereto, the line passing over a pulley, then receiving weights. The weights are designed to nest together to prevent relative movement therebetween. A bracket is fixable to an interior doorway to carry a pulley for directing the line for exercise. In exercising, one grips the simulated ball in the manner of the real ball, and exercises by moving the arm in the same manner one would throw the ball, thereby exercising exactly the same muscles and groups of muscles used in the sport represented by the simulated ball.

7 Claims, 1 Drawing Sheet 35
31
18
32
16
12
10
11

30
38
28
29
18
35
31
16
12
34
19
11
20
25
22
24
26
21

15
15
14
15
44
42
45
48
41
46
15

12
38
16
39
40
36

11
51
51
51
51
10A 14
15
49
50

THROWING ARM EXERCISING APPARATUS

INFORMATION DISCLOSURE STATEMENT

There are numerous exercising devices in the prior art, and one of the very common forms of exercising apparatus includes a pulley having a line thereover, and a weight on one end of the line. In exercising, a person pulls on the opposite end of the line, thereby pulling against the weight. Examples of such apparatus are shown in U.S. Pat. Nos. 499,205 to Bryon, Jr., 2,918,282 to Waterval and 3,115,339 to Forte. An example is also shown in French patent No. 1,497,600 to Villenave.

The prior art exercising apparatus includes various arrangements for mounting pulleys, for guiding weights, for changing the amount of weight, and other such mechanical features. The prior art, however, tends to continue to use the same basic arrangement wherein a handle is provided at the end of a line, the exerciser grasping the handles for exercising. Such exercising apparatus is satisfactory when the purpose of the exercise is for the non-specific development of shoulder muscles, back muscles and the like. There is no consideration for the development of carefully selected groups of muscles.

SUMMARY OF THE INVENTION

This invention relates generally to exercising apparatus, and is more particularly concerned with an exercising apparatus wherein a carefully selected group of muscles is exercised, and developed or rehabilitated.

The present invention provides an exercising apparatus including a gripping means to be gripped by the hand of the exerciser, a line fixed to the gripping means, and resistance means for the exerciser to work against. In the preferred embodiment of the invention, the resistance means comprises a plurality of weights selectively fixable to the line, the weights being nested to prevent relative motion therebetween. The gripping means simulates a sports ball or the like so the exerciser can exercise using the precise group of muscles used in throwing the ball simulated, with the same joint rotation. A pulley is disposable to hold the line in position to allow the exerciser to move in the natural motion used to throw the ball simulated.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENTS

Figures 1, 2, 3, 4, 5, 6:
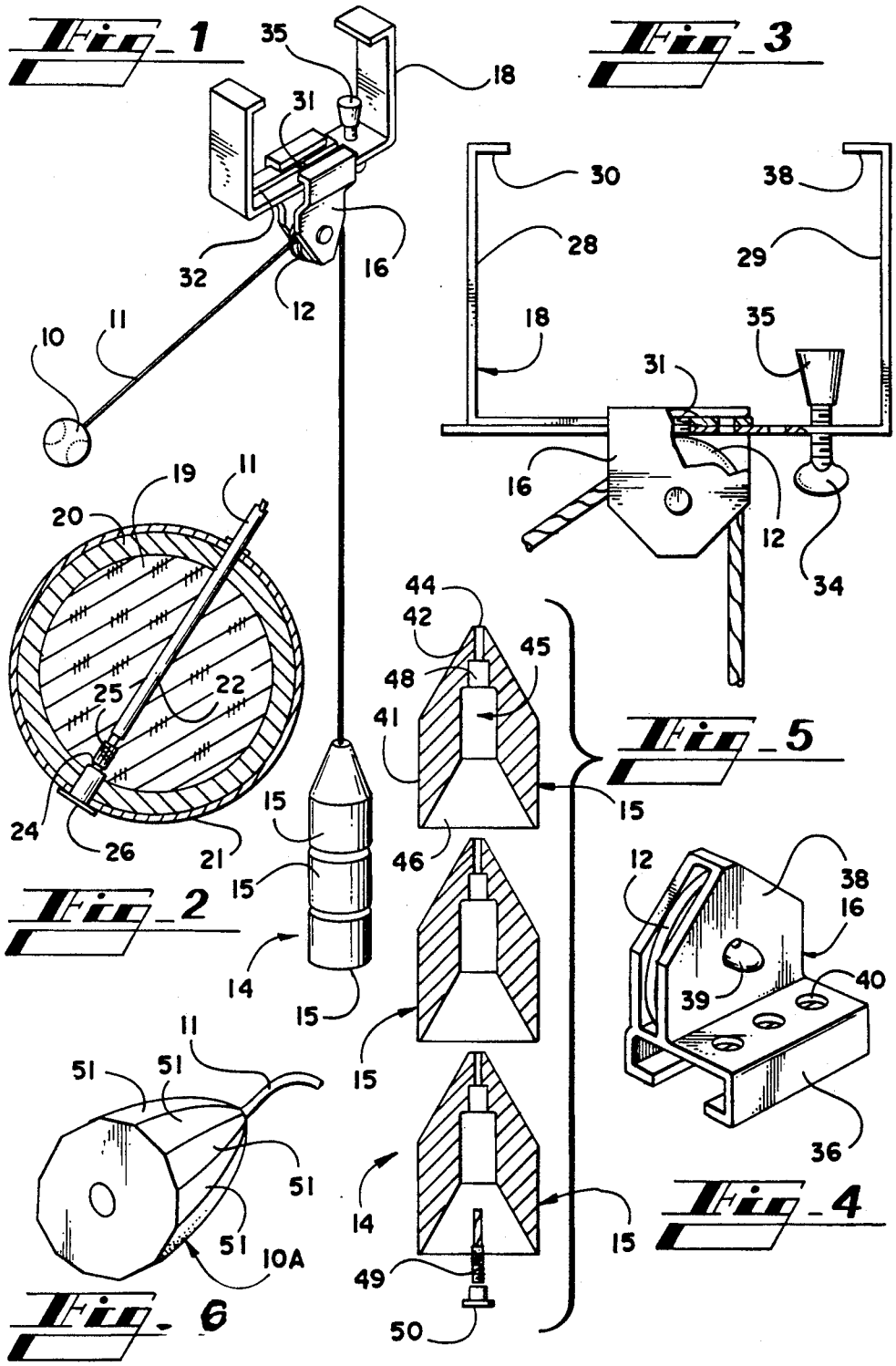
FIG. 1 is a perspective view showing an exercising device made in accordance with the present invention.
FIG. 2 is an enlarged, diametrical cross-sectional view showing the gripping means used in the embodiment of the invention shown in FIG. 1.
FIG. 3 is a side elevational view, partially in cross-section, showing the pulley of FIG. 1, and the mounting means therefor.
FIG. 4 is a perspective view showing the construction of the pulley used in the device of FIGS. 1 and 2.
FIG. 5 is an exploded, cross-sectional view showing the resistance means used in the embodiment of the invention shown in FIG. 1; and, FIG. 6 is a perspective view showing a modified form of ripping means for use with the present invention.

Referring now more particularly to the drawings, and to those embodiments of the invention here presented by way of illustration, the device shown in FIG. 1 includes a gripping means 10 here shown as simulating a baseball. The gripping means 10 is carried at one end of a line 11 which is trained over a pulley 12. The opposite end of the line 11 then carries the resistance means 14 which is here shown as consisting of three weights 15.

The pulley 12 is mounted in a housing 16 which is carried by a bracket 18. The bracket 18 is adapted to be supported at the top of a conventional interior doorway, and the details of the construction will be discussed below.

FIG. 2 of the drawings shows the gripping means 10 in detail. The gripping means 10 simulates a baseball, and the construction here shown utilizes an actual baseball as the gripping means. As is conventional for baseballs, the gripping means 10 includes a cork center 19 with a string winding 20, and a leather cover 21.

A hole 22 is drilled through the ball to receive the end of the line 11. The end of the line 11 has a stud 24 fixed thereto, as by crimping a receptacle at 25. A conventional headed nut 26, known as a riv nut, is threadedly received on the stud 24 to secure the line to the gripping means 10. A washer 27 surrounds the line 11 and the hole 22 for a neat appearance.

The preferred construction is illustrated in FIG. 2 of the drawings; however, it will be understood by those skilled in the art that numerous other forms of connection may be used.

For an exercise device of the type here contemplated, it must be realized that silence of the device is important. The usual weight lifter may be accustomed to the clanging of metal weights, but the present device is designed for use by, for example, a baseball pitcher, who must concentrate on the technique for throwing. Rattling, clanging, squeaking and other such noises emitted by the exercising apparatus would be highly distracting, and would greatly diminish the value of the device.

One feature that reduces noise in the device of the present invention is the use of a stranded cable covered with a plastic such as vinyl. The cable preferably has a large number of strands for great flexibility, and a plastic covering for silence in use. Such a line can be durably fixed to the gripping device 10 by having the stud 24 crimped onto the cable, the plastic covering being peeled back somewhat.

FIG. 3 shows the pulley 12 and the support means for the pulley 12. First it should be mentioned that the pulley 12 must be quiet. In the preferred embodiment of the invention, the pulley is made of nylon, and no additional bearing is required. This arrangement is quiet, and is very satisfactory. It will be understood that other arrangements may be used, but may be more expensive. However, it will be obvious that other plastic materials may be used in lieu of nylon, the criteria being that a good bearing surface is provided, and that the pulley is quiet in operation.

As shown in FIG. 3 of the drawings, the pulley 12 is received within the housing 16 which is selectively fixable to the bracket 18. The construction of the pulley housing 16 will be discussed in more detail below. The bracket 18 includes a pair of L-shaped members 28 and 29, each of the L-shaped members having an inwardly turned ear 30 at its upper end. The lower arms of the L-shaped members 28 and 29 overlap, and are fixed together, as by a screw 31. The screw 31 passes through a slot 32 in the L-shaped member 28 and a hole in the L-shaped member 29. The screw 31 then passes through a hole in the pulley housing 16 so the entire assembly is secured by the one screw 31.

A thumbscrew 34 is threaded through a hole in the L-shaped member 29, and the upper end of the screw 34 mounts a tip 35, preferably made of rubber or the like.

It should be understood from the above description that the bracket 18 will mount the pulley housing 16; then, the two members 28 and 29 of the bracket 18 can be adjusted so the ears 30 engage the top of a door casing. When the bracket 18 and the pulley housing 16 are properly adjusted, a nut will be tightened on the screw 31 to hold the parts as set, and the thumbscrew 34 will be used to tighten the tip 35 against the doorway. The bracket 18 is then ready for a person to exercise.

FIG. 4 shows the pulley housing 16 in more detail, and it will be seen that the housing 16 includes a C-shaped body 36 for receiving the lower legs of the L-shaped members 28 and 29. A clevis 38 is fixed to the body 36 at one side thereof, the clevis 38 receiving the pulley 12. A clevis pin 39 passes through the clevis 38 and the pulley 12 for rotatably mounting the pulley 12.

The clevis 38 is fixed at one side of the body 36 and this provides space for the holes 40 through the body 36. It is contemplated that the center hole 40 will receive the screw 31 therethrough, though of course either of the other holes 40 could also be used. Also, if a person wishes to mount the exercising device of the present invention somewhat permanently, it will be understood that the holes 40 may receive wood screws for fixing the pulley housing 16 directly to a doorway, or other surface.

Attention is now directed to FIG. 5 of the drawings for a detailed discussion of the resistance means 14. It will be noticed that there are three of the weights 15 shown, and it will be understood that any number of weights may be used as desired. A single weight may be used as a beginning, and one may add as many weights as desired, though it is contemplated that three weights is the maximum for general use.

Each of the weights 15 includes a lower portion 41 that is cylindrical, and an integral upper portion 42 that is frustoconical. An axial bore 44 extends from the uppermost end of the upper portion 42 to the interior cavity 45. The interior cavity 45 has a lower portion 46 that is frustoconical, the base angle of the cone 46 being equal to the base angle of the cone of the upper portion 42 of the weight 15. There is then a stepped cylindrical portion 48 of the cavity 45.

The bore 4 is designed to receive the line 11 therethrough. The end of the line 11 has a stud 49 fixed thereto, for example by a crimped receptacle as in FIG. 2 of the drawings. A knurled finger nut 50 is threadedly receivable on the stud 49. Preferably, the stud 49 with the line 11 fixed thereto can pass through the bore 44 of the weight 15. As a result, simply by removing the nut 50, weights can be added or removed. When the desired number of weights is on the line, the nut 50 is threaded onto the stud 49, and the nut 50 will bear against the flat area between the cylindrical portion 48 and the bore 44.

With the above description in mind, it will be understood that the exercising device of the present invention can be packed into a small space for storage. When the device is to be used, the bracket 18 with the pulley housing 16 will be fixed to a doorway. The line 11 will be passed over the pulley 12, and through the desired number of weights 15. Since the angle of the frustoconical portion 42 of the weight and the frustoconical portion 46 of the cavity 45 are equal, the weights will nest tightly together. Also, the cylindrical portion 48 of the cavity 45 assures that the tip of one weight will not engage the bottom of the cavity, so the weights are tightly urged together.

Once the apparatus is set up, a person can grasp the gripping device 10 and pull on the line 11 to begin the exercise. By way of example, if a baseball pitcher is using the device, the exerciser will grip the gripping means 10 in the same way he would normally grip a baseball for pitching. This act of gripping the gripping means 10 pulls specific muscles in the hand and arm. With these specific muscles in tension, the person will now position his arm as he would in pitching the baseball.

Thus, the baseball grip allows a sports specific training to be performed. The baseball grip and orientation of forces allow a superior exercise to be performed by synchronizing muscular function and joint rotation of the shoulder, elbow, wrist and hand, fluidly reproducing the act of throwing a baseball. Now, as the arm is moved in precisely the way the arm would be moved to pitch a baseball, the person is working against the weights 15 of the resistance means 14. Due to the positioning of the pulley, the person can move his arm in any normal way a pitcher would move in an actual baseball game. Each of these motions is carried out with the gripping means 10 gripped in the same manner as one would grip a baseball. The most important muscle group involved in throwing a baseball is the rotator cuff group. The present invention provides specific exercise for this particular muscle group, so superior results are achieved.

Since exactly the same muscles that are used in a baseball game can be exercised using the apparatus of the present invention, a pitcher can exercise the proper muscles to develop the muscles, or of course an injured player can exercise the muscles for purposes of rehabilitation. Furthermore, the baseball pitcher was used only by way of illustration, and other positions on a baseball team, and other sports, can also use the device to advantage. A fielder might use the device to improve throwing ability, for example. Other balls may be simulated to allow use in other sports.

FIG. 6 shows a modified form of gripping means designated at 10A. This device is designed to simulate a football. Since a person grips only half of a football, only half the ball is required, so there is a generally hemi-ellipsoidal shape having the line 11 fixed to the gripping means 10A at the smaller end. Rather than having a smooth surface like an actual football, the gripping means 10A comprises a plurality of facets 51 to provide a firm grip for exercising. Other aspects of the invention are as discussed above and will not be repeated.

It will therefore be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

I claim:

1. In an exercising apparatus comprising a gripping means, a line fixed to said gripping means, a pulley for receiving said line thereover for changing the direction of forces on said line, and resistance means fixed to said line, the arrangement being such that a person exercising can pull on said gripping means and the person will pull against said resistance means, the improvement wherein said gripping means simulates a sports ball so that the exerciser can grip said gripping means in the same way one would grip the sports ball simulated during the exercising, said resistance means comprises a plurality of weights selectively receivable on said line, each weight of said plurality of weights including an upper portion and a lower portion, each weight further defining a central cavity having a lower portion, said lower portion of said central cavity being within said lower portion of said weight, said upper portion of said weight being frustoconical and said lower portion of said central cavity being frustoconical for receiving said upper portion of one of said weights therein, said frustoconical upper portion of said weight and said frustoconical lower portion having the same angle so that contiguous weights are urged tightly together.

2. In an exercising apparatus as claimed in claim 1, the improvement wherein said bracket comprises a pair of L-shaped members having lower arms, said lower arms overlapping and receiving said pulley housing thereon, the arrangement being such that said pair of ears engage said casings of said doorway and said pulley housing is disposed within said doorway carried by said pair of L-shaped members.

3. In an exercising apparatus as claimed in claim 2, the further improvement comprising a thumbscrew threaded through at least one of said lower arms of said L-shaped members and selectively engageable with said doorway for holding said pair of ears against said door casings.

4. In an exercising apparatus as claimed in claim 1, the improvement wherein each weight of said plurality of weights defines an axial bore through said upper portion and communicating with said central cavity for receiving said line therethrough.

5. In an exercising apparatus as claimed in claim 4, the improvement wherein said gripping means comprises a regulation baseball defining a hole therethrough, said line being received in said hole and extending through said baseball, and including attaching means for fixing said line to said baseball.

6. In an exercising apparatus as claimed in claim 4, the improvement wherein said gripping means comprises a hemi-ellipsoidal member simulating a football.

7. In an exercising apparatus as claimed in claim 1, the further improvement including a bracket receivable in a doorway, said bracket having a pair of inwardly turned ears for engaging the door casings on each side of said doorway, and a pulley housing carried by said bracket.

* * * * *